United States Patent [19]

Brynko et al.

[11] 4,133,774

[45] Jan. 9, 1979

[54] PROCESS FOR PREPARING DIRECT IMAGING PRESSURE FIXABLE MAGNETIC TONERS

[75] Inventors: Carl Brynko; Carl G. Brynko, both of Oakland, N.J.

[73] Assignee: Reprographic Materials, Inc., Pompton Lakes, N.J.

[21] Appl. No.: 837,693

[22] Filed: Sep. 29, 1977

[51] Int. Cl.[2] ..... G03G 9/08

[52] U.S. Cl. ..... 252/62.1 D; 96/1 SD; 159/48 R; 252/62.1 R; 252/62.53; 252/62.54; 252/316; 252/511; 427/218; 427/221

[58] Field of Search ..... 252/62.1 R, 62.1 P, 252/511, 62.1 PM, 62.54, 62.53, 316; 427/218, 221; 96/1 SD; 159/48 R

[56] References Cited

U.S. PATENT DOCUMENTS

| | | | |
|---|---|---|---|
| 3,196,032 | 7/1965 | Seymour | 252/62.1 P |
| 3,280,741 | 10/1966 | Seymour | 252/62.1 P |
| 3,698,005 | 10/1972 | Naci et al. | 252/62.1 P |
| 3,745,118 | 7/1973 | Brynko | 252/62.1 P |
| 3,788,994 | 1/1974 | Wellman et al. | 252/62.1 P |
| 3,925,217 | 12/1975 | Strong | 252/62.1 P |
| 4,016,099 | 5/1977 | Wellman et al. | 427/221 |

FOREIGN PATENT DOCUMENTS

| | | | |
|---|---|---|---|
| 2456432 | 8/1976 | Fed. Rep. of Germany | 252/62.1 P |
| 2606936 | 9/1976 | Fed. Rep. of Germany | 252/62.1 P |

OTHER PUBLICATIONS

Chemical Abstracts, Sone et al., 85:134326z (1976).

*Primary Examiner*—John D. Smith
*Attorney, Agent, or Firm*—Brooks, Haidt, Haffner & Delahunty

[57] ABSTRACT

Novel pressure fixable direct imaging magnetic toners having a core of magnetic material held together with an adhesive resin, a barrier substantially covering the core, an overcoat of thermoplastic strengthening resin, and an outer conductive layer, together with novel processes for producing such toners, these processes comprising dispersion of the core material followed by agglomeration of the several layers in a single aqueous medium.

12 Claims, No Drawings

PROCESS FOR PREPARING DIRECT IMAGING PRESSURE FIXABLE MAGNETIC TONERS

BACKGROUND OF THE INVENTION

This invention relates to developers for use in electrophotographic recording equipment, and more specifically, it relates to dry particulate developers ("toners") having magnetic and other properties particularly suited for direct imaging, together with novel processes for producing such developers.

In many electrophotographic processes, a photoconductive surface (usually coated on a substrate) is electrostatically charged, and an image to be reproduced is projected thereon to produce a latent electrostatic image corresponding to the light and dark pattern of the projected image. This latent electrostatic image is then developed by contacting the surface of the photoconductor with a developing agent or "toner" which adheres electrostatically to the imaged areas. In one widely used technique, the application of the toner to the latent image is carried out with a developer mixture composed of carrier beads and toner which adheres to the carrier beads by electrostatic attraction. The carrier bead-toner mixture is distributed over the photoconductive surface through some mechanical action such as brushing, cascading, immersion or the like, and the toner adheres electrostatically to the charged areas. The degree of development is crucial to the clarity and intensity of the image.

After the image has been toned, or made visible on the photoconductive surface, additional steps must be taken to provide a fixed image for later use. Two general systems are prevalent in electrophotography to produce a permanent fixed image: direct systems and transfer systems. In direct systems, the image is developed on the photoconductor, and the developed image is directly bonded to the surface of the photoconductor. In transfer systems, the latent image on a surface is transferred to another substrate, by electrostatic means, and then bonded to the new substrate to produce a permanent image.

The bonding action, in either type of system, has been achieved by several methods. A common method is to apply heat to the substrate and thereby to melt the thermoplastic resin in the toner, which will fuse the pigmented toner to the substrate. Another method is to apply pressure to the toner and substrate, so that resinous material in the toner is forced onto the substrate to form a bond and hold the toner to the substrate. Solvents have been used, partially to dissolve the resins in the toner, creating an adhesive bond between the toner and the substrate.

Other types of developer inks occur, but these are manufactured by admixing pigments and resins by blending, mixing or milling, and, to obtain a uniform distribution of the pigment in the resin, the blending must be done above the melting point of the thermoplastic resin. The mixture is fused and allowed to cool and harden. The solid composition is then broken up or pulverized, as by ball milling. The particles are then treated with additional additives to alter their electrical properties and are further subjected to processing methods which melt or soften the resin to allow for partial or complete mixing of the additives. Powders prepared by this method suffer from a number of disadvantages among which are:

1. Wide particle size distribution: This is due to the grinding or pulverizing operations, and additional steps of particle size classification are generally required to create a useful developer ink.

2. Particles of non-uniform electrostatic properties: This is due to the need to blend components or additives into the hardened blend of resin and pigment, without softening the resin, to a point where uniformity can be obtained.

3. Expensive and tedious material and processing operations, with a low yield of usable material.

The art of electrophotographic recording devices and equipment is well known. Xerography, the most widely practiced form of electrophotography, and the composition of toners, therefor, are more fully described in Carlson U.S. Pat. No. 2,297,692, and Walkup U.S. Pat. Nos. 2,228,416; 2,618,551, and 2,618,552. Brynko U.S. Pat. No. 3,745,118 describes a toner which contains agglomerated pigment particles overcoated through spray drying with a thermoplastic resin.

Other types of electrophotographic devices require toners having differing electrical properties, and have been described in West U.S. Pat. No. 3,166,510, as well as in Seymour U.S. Pat. Nos. 3,196,032 and 3,280,741, and in Nelson U.S. Pat. No. 3,639,345. Magnetic developing techniques have been described in Gundlach U.S. Pat. No. 3,166,432 and in Kotz U.S. Pat. No. 3,909,258.

THE INVENTION

The present invention provides a novel material which can be readily and inexpensively prepared through utilization of a single aqueous medium. The product is a novel developing ink or toner for use in electrophotographic reproduction processes involving the use of a magnetic material which is subsequently affixed to a substrate through the use of pressure. The present invention obviates the low yields and the numerous classification steps which have heretofore been generally used to prepare magnetic toners for direct imaging.

Briefly, the present invention provides toners successively having a core of magnetic material and adhesive resin, a barrier substantially covering the core, a resin overcoat to provide additional strength, and an electrically conductive surface layer. Such toners are provided through the use of a process wherein a magnetic material is dispersed in an aqueous medium and blended with an adhesive resin, the dispersed particles and adhesive resin are agglomerated with a barrier material, the agglomerates are encased in an overcoat of strength-providing resin, and a final electrically-conductive resin coating is disposed on the overcoated particles so formed.

The core of the toner particles comprises the magnetic material and the adhesive resin which bonds the particles to the substrate upon which the image is to be formed. Various magnetic materials can be incorporated into the core of the toner particles of the present invention. The magnetic materials should have sufficient magnetic properties so that the finished particles are attracted to the magnetic brush of the copying machine and a particle size sufficiently small so that the finished toner particles have the desired size range, as taught herein. They preferably have sufficient color and opacity that they will furnish a portion or all of the requisite color to the finished image. More specifically, the particle size for the magnetic materials is in the range of from 0.1 micrometers to 3 micrometers.

Various substances exhibit sufficient magnetic susceptibility for incorporation into the cores of toners according to the present invention. Such materials include barium titanate, chromium dioxide, various iron oxides, and the like. A particularly preferred material used herein is magnetite, $Fe_3O_4$, by reason of its good magnetic susceptibility, availability, particle size, and economy.

The first resin, utilized for the core, is a material possessing pressure-sensitive adhesive properties. It should have the ability to adhere to the substrate under pressure so that it can be used in the bonding process between the particles of coloring matter and the substrate. It is this first resin which acts to fix the developed electrophotographic image under the influence of pressure, such as that in the nip of rolls on the copying machine. It is desirable in certain embodiments that it possess wax-like properties. Typical of resins for use in the core are polyvinyl acetates, polyethylene emulsions, low-melting acrylic resins, elastomeric or rubber-like resins such as Hevea, butadiene-styrene, and combinations thereof with tackifying resins such as dehydrogenated rosin and the like.

The next resin comprising the novel toner particles is the barrier resin. It is selected from materials which will serve to enclose the agglomerate containing the pressure-sensitive material and prevent it from interacting with the subsequent layers to be deposited upon the toner particles. The barrier resin also protects the core with its pressure-sensitive resin from the thermal conditions used in the drying of the finished toner particles.

This barrier should completely enclose the core, but need not be of considerable thickness, provided that under the thermal conditions of drying, for example, spray-drying, the barrier does not melt below 100° C., and preferably not below 150° C., and thereby dissolve the adhesive resin. In other words, a substantially continuous integument should be provided by the barrier resin. Resins utilized for this purpose according to the present invention are gelatins and water-soluble polymers or colloids such as ethylene maleic anhydride copolymers, acrylamides, acrylic acids, cellulose acetate phthalates, carboxymethyl cellulose, and the like.

The third or overcoat resin is used as the strengthening resin in the toner particle. These resins must have structural strength to maintain the particle's form. They impart sufficient rigidity to the core and barrier so that they will not be crushed during processing, and more importantly, so that the granules will have sufficient strength to withstand the tumbling, impact, and other forces that the toner is subjected to in electrophotographic copying machines, as well as in storage.

While the overcoat resin protects the inner components, it should be friable so that it will release the adhesive resin under pressure. It has been found that resins melting in the range of 100° to 150° C. have the correct rheology for the friability. The melting temperature is a good indicium of strength.

The overcoat resin should also be relatively resistant to moisture so that it protects the underlying materials from ambient humidity. Preferred resins found useful as overcoat resins in the present invention include styrene-acrylate copolymers, styrene methacrylate copolymers, methacrylates, cellulose acetate phthalates, and the like.

The final layer or stage is the electrically conductive layer. This layer must provide the electrical properties necessary in electrophotographic reproduction methods. In preparing toners such as the present products, the conductivity properties utilized are those required for the specific machine on which the toner is intended for use. Thus, the electrical conductivity can vary from about $10^{-2}$ to $10^{-10}$ mho/centimeter. Resins meeting this criterion include melamines, urea-formaldehyde, phenol-formaldehydes, triazines and the like.

It has also been found that the incorporation of a carbon black dispersion in the conductive layer resin can be used to augment the conductivity of other resin materials. This provides an important tool in adjusting the electrical properties. When carbon black is utilized, the conductivity of the outermost resin layer is not as crucial, although in such instance, the resin should be capable of being coacervated with the carbon black dispersion.

It is apparent to those skilled in the art that the finished size of the toner particles is important to their use as toners. Particles which are too coarse will not permit the copying processes to have a sufficiently high resolving power. On the other hand, particles of too small a size are undesirable because they produce "background", that is, a distribution of particles in areas which should be totally free of image. While the specific particle size will vary depending upon the particular copying machine to be used, it is generally desirable that the effective outside diameter of the particles be from 3 micrometers to 35 micrometers.

With these overall dimensions in mind, the effective diameter of the core ranges from 2 to 20 and that of the overcoated core from 3 to 30 micrometers. It is one of the advantages accruing to the present invention that the size of the core and each layer can be controlled to provide optimum performance for a given use. The toners of the present invention provide magnetizable particles for use in magnetic development techniques such as those described in U.S. Pat. No. 3,909,258. Preferred substrates herein are ordinary bond or sulfite papers.

The processes of the present invention for forming the particles are entirely conducted in an aqueous medium. The particles are thereafter dried by conventional means. More specifically, the processes of the present invention utilize the agglomeration of pigments and resins, such as a dispersion of carbon black, magnetic materials, and resin emulsion in an aqueous system to form the core.

The dispersion of the carbon black and magnetic oxide will agglomerate with the pressure-sensitive resin to produce uniform particles which serve as the binding agent to hold the particle to the substrate. After the agglomeration of the core and barrier are complete, a resin emulsion is added to serve as overcoat for the core. The strengthening resin is deposited upon the core particles. The final surface conductive layer is deposited on the particles to provide the necessary electrical properties, as described above.

Agglomeration of pigment particles has been described in Brynko U.S. Pat. No. 3,844,811, wherein spherical pigment particles of uniform size are obtained by mixing a material capable of coacervation with an aqueous dispersion of water-insoluble pigment particles and an ionic surfactant to cause phase separation of the system and thereby effect agglomeration of the pigment particles.

In this invention, an aqueous dispersion is produced by mixing magnetite and a surfactant, and is blended with an organic resin. Coacervation is induced and agglomerates are produced, which contain the magnetic particles held firmly together with the pressure-sensitive resin. Since this agglomeration procedure produces uniform spherical particles dispersed in the aqueous medium, all subsequent steps will be conducted by the addition of materials to this aqueous medium. In order to provide a barrier or separating layer for these agglomerates, a resin solution or emulsion is added in sufficient quantity to completely encapsulate the agglomerates. This encapsulation occurs through the coacervation of a coacervatable material present in this second resin solution.

Upon completion of this encapsulation step, a resin emulsion is added to provide the strengthening coat. After the deposition of the strengthening coat is complete, the final resin solution is added and deposited on the surface of the capsule to provide a conductive layer over the previously deposited layers. Thereafter, the capsules are removed from the aqueous mixture by conventional solid-liquid separation and drying techniques.

The powder so produced contains agglomerates of magnetic material held together with the adhesive resin, protected by a barrier layer of resin, overcoated or encapsulated by a layer of thermoplastic resin to provide strength to the structure, followed by an encapsulation of a conductive layer to provide the electrical properties for use in the electrophotographic device. Thus, the powder produced will serve in the developing step of magnetic development, tone the latent image, and under pressure will bond to the substrate and provide a permanent visible image.

In electrophotographic devices, the optimum use of this type of powder requires that the particle size, density and magnetic properties be adjusted in relation to each other for the most advantageous use of the material. It may therefore be necessary for mechanical classification of the material to allow it to be utilized from device to device. This classification, if necessary, is conducted by conventional classification processes.

Following the deposition of the last layer of resin, the particles are dispersed in water, and can be removed and dried by conventional means, such as air flow, spray tower, or dehydration by chemical means. Spray drying is preferred for many applications, wherein the final conductive coat contains a polymer which can be cross linked or polymerized by the application of heat used in the spray drying operation.

While the toners of the present invention can be used on any magnetic direct imaging electrophotographic copying machines, the tests conducted in connection with illustrating the present invention are generally carried out on a 3M VQC II Copier.

The following Examples are designed to show the effect of varying the concentration or type of components used in preparing samples of magnetic toner. These variations were carried out in all layers of the toner particles.

The following Examples are given to illustrate embodiments of the invention as it is presently preferred to practice it. It will be understood that these Examples are illustrative, and the invention is not to be considered as restricted thereto except as indicated in the appended Claims.

Examples I, II, III and XVII show the effect of pressure sensitive material used in the preparation of the core. The test prints of these four examples demonstrate that a variety of materials can be used as the pressure sensitive material. The significant differences in these examples are the degree of gloss in the imaged areas. The Diamond Shamrock polyethylene MS-40 produces the glossiest finish which is comparable to a 3M print whereas the Borden Polyco 2140 is almost a matte finish. The degree of pressure fixing in all samples is comparable to the 3M print.

In Examples I, X, and XI, different magnetic oxides were used, and the test results indicate no significant differences in print characteristics. In the preparation of the samples, however, it is observed that the Pfizer magnetic oxide is the most difficult to disperse.

In Examples I, VI, VII, and XVIII, the amount of magnetic oxide is varied from 64% down to 38%. The test results indicate that at levels of 50% or higher print quality is good, but at the lowest level in Example VII the print is fuzzy and has considerable background.

Example XVIII is a repeat of Example VII, except that carbon black is added to the core to increase the bulk conductivity, and this results in a much improved print sample.

Examples I, XII, and XIII illustrate the effect of coacervatable materials on core formation. In these Examples, the concentration of gelatin is varied from 2 to 6% with no apparent change in preparation of samples or in test copies made on the 3M copier.

Several resins are used to illustrate their effect on the formation of the overcoat. Examples I, VIII, and IX are prepared with three different resins acting as overcoat for the core, with no apparent alteration in the properties of the final magnetic toner.

The formation of the conductive layer is the subject of several variations. Example XVI is a repeat of Example III with the exception that the conductive layer is omitted. Test copy results indicate the toner from Example XVI produces extremely dirty copies when tested on a 3M VQC II type copier. This same toner when blended with 0.5% by weight of dry carbon black produces copies equivalent to copies made with the Example III toner.

Examples III, IV, and V are prepared using different resins to deposit the surface conductive layer. Test results indicate that the prints from all three samples are equivalent.

Examples XI, XIV, and XV use varying amounts of carbon black dispersion in the surface conductive layer. These samples when tested show that the carbon black levels of from 5 to 15% by weight of the toner are all comparable in print quality.

Examples XIX and XX illustrate that conductive resins such as urea-formaldehyde and melamine can serve effectively as a surface conductive layer. It should be noted that in order to have sufficient optical density some carbon black dispersion is incorporated into the core.

EXAMPLE I

A 2-liter stainless steel beaker is charged with 392 g of magnetic oxide dispersed in water with an anionic surfactant and containing 76.4% magnetic oxide and manufactured by Wright Industries, Inc., Brooklyn, New York, and 250 g of water is added at 40° C., using a variable speed Lightning stirrer for 10 minutes to disperse the magnetic oxide. One hundred grams of a 10% aqueous solution of Superclear gelatin manufactured by Swift & Company, Chicago, Illinois, is slowly added and stirred for 15 minutes. The pH of this system is 6.8.

A separate beaker is charged with 200 g of 40% solids nonionic polyethylene emulsion, MS-40, manufactured by Diamond Shamrock, Morristown, N.J., and diluted with 200 g of water at 40° C., thoroughly dispersed, and slowly added to the stainless steel beaker. At this point microscopic observation indicates that agglomeration has occurred and that the agglomerates are 3–8 micrometers in diameter. These agglomerates form the core and barrier for the pressure fixable toner.

The overcoat for the core is a terpolymer emulsion of butyl acrylate, methyl methacrylate and methacrylic acid having the monomer ratio — 45:45:10, made by interpolymerizing the three monomers in aqueous emulsion using an anionic surfactant, A-103, manufactured by American Cyanamid. One hundred grams of this emulsion having 40% solids is slowly added to the slurry in the stainless steel beaker and stirred for 15 minutes. At this point the terpolymer strengthening layer has deposited, and the pH of the agglomerates having a size range of 5–15 micrometers is 4.5. Two grams of a 25% aqueous solution of glutaraldehyde is added to crosslink the gelatin and it is cooled to 30° C.

To form the final conductive surface layer, 40 g of a 3% aqueous solution of A370 polyacrylamide manufactured by American Cyanamid is added to the stainless steel beaker, and 100 g of a 45% carbon black dispersion containing Regal 400 carbon black manufactured by CDI Dispersions, Newark, N.J., diluted with 380 g of water, is slowly added to the agglomerate system. As the carbon black dispersion is added, it is deposited on the surface of the agglomerates. After 20–25 minutes of stirring there is essentially no background in the water phase and the pH of the system is 6.7. The pH is lowered to 6.0 with 10% acetic acid and the material is diluted with an additional 500 g of water.

To obtain a dry powder, the slurry is spray dried in a Bowen laboratory spray drier, utilizing a spray wheel, an inlet temperature of 260° F., and an outlet temperature of 140° F. to remove the water. The powder is collected, screened through a 200-mesh sieve and then tested in a 3M VQC II copier. Test results indicate that the print quality is comparable to the 3M VQC type 361 toner.

EXAMPLE II

A magnetic oxide dispersion in aqueous gelatin is prepared to have a pH of 6.8 as in Example I.

A separate beaker is charged with 230 g of a 35% solids anionic polyethylene emulsion N-35 manufactured by Chemical Corporation of America, East Rutherford, New Jersey, and 200 g of water at 40° C. The emulsion is dispersed thoroughly and slowly added to the stainless steel beaker. At this point microscopic observation indicates that agglomeration has occurred and that the agglomerates are 3–10 micrometers in diameter. These agglomerates form the core and barrier for the pressure fixable toner.

The overcoat for the core is prepared by adding 100 g of the terpolymer emulsion of Example I. At this point the pH of the agglomerates having a size range of 5–20 micrometers is 8.4. Then 2 g of a 25% aqueous solution of glutaraldehyde is added to crosslink the gelatin and it is cooled to 30° C.

To form the final conductive surface layer, 24 g of a 5% aqueous solution of EMA-1103 ethylene maleic anhydride copolymer manufactured by Monsanto, St. Louis, Missouri, is added to the stainless steel beaker and 100 g of a 45% carbon black dispersion containing Regal 400 carbon black manufactured by CDI Dispersions, Newark, New Jersey, diluted with 380 g of water is slowly added to the agglomerate system. As the carbon black dispersion is added, it is deposited on the surface of the agglomerates. After 20–25 minutes of stirring there is essentially no background in the water phase and the pH of the system is 8.1. The pH is lowered to 6.0 with 10% acetic acid and an additional 500 g of water is added.

To obtain a dry powder, the slurry is spray dried in a Bowen laboratory spray drier with a spray wheel, an inlet temperature of 280° F., and an outlet temperature of 140° F. to remove the water. The powder is collected, screened through a 200-mesh sieve and then tested in a 3M VQC II copier. Test results indicate that the print quality is comparable to the 3M VQC type 361 toner.

EXAMPLE III

A magnetic oxide dispersion in aqueous gelatin is prepared to have a pH of 6.8 as in Example I.

A separate beaker is charged with 320 g of a 25% solids anionic polyethylene emulsion A-25 manufactured by Chemical Corporation of America, East Rutherford, New Jersey, and 200 g of water at 40° C. The emulsion is dispersed thoroughly and slowly added to the stainless steel beaker. At this point microscopic observation indicates that agglomeration has occurred and that the agglomerates are 5–12 micrometers in diameter. These agglomerates form the core and barrier for the pressure fixable toner.

The overcoat for the core is prepared by adding 100 g of the terpolymer emulsion of Example I. At this point the pH of the agglomerates having a size range of 5–20 micrometers is 8.6. Then 2 g of a 25% aqueous solution of glutaraldehyde is added to crosslink the gelatin and it is cooled to 30° C.

To form the final conductive surface layer, 40 g of a 3% aqueous solution of A370 polyacrylamide manufactured by American Cyanamid is added to the stainless steel beaker, and 100 g of a 45% carbon black dispersion containing Regal 400 carbon black manufactured by CDI Dispersions, Newark, New Jersey, diluted with 380 g of water is slowly added to the agglomerate system. As the carbon black dispersion is added, it is deposited on the surface of the agglomerates. After 20–25 minutes of stirring there is essentially no background in the water phase and the pH of the system is 8.6. The pH is lowered to 6.0 with 10% acetic acid and an additional 500 g of water is added.

To obtain a dry powder, the slurry is spray dried in a Bowen laboratory spray drier with a spray wheel, an inlet temperature of 260° F., and an outlet temperature of 140° F. to remove the water. The powder is collected, screened through a 200-mesh sieve and tested in a 3M VQC II copier. Test results indicate that the print quality is comparable to the 3M VQC type 361 toner.

EXAMPLE IV

A magnetic oxide dispersion in aqueous gelatin is prepared to have a pH of 6.8 as in Example I. Agglomerates are formed with A-25 as in Example III, and a terpolymer overcoat is prepared as in Example I.

At this point the pH of the agglomerates having a size range of 5–20 micrometers is 8.6. Then 2 g of a 25% aqueous solution of glutaraldehyde is added to crosslink the gelatin and it is cooled to 30° C.

To form the final conductive surface layer 24 g of a 5% aqueous solution of P-26 polyacrylamide manufactured by American Cyanamid is added to the stainless Test results indicate that the print quality is comparable to the 3M VQC type 361 toner.

EXAMPLE IX

A magnetic oxide dispersion is agglomerated according to the procedure in Example III.

The overcoat for the core is a terpolymer emulsion of styrene, butyl methacrylate and methacrylic acid having the monomer ratio — 56:40:4 made by interpolymerizing the three monomers in the presence of A-103 anionic surfactant. One hundred grams of this emulsion having 40% solids is slowly added to the slurry in the stainless steel beaker and stirred for 15 minutes. At this point the pH of the agglomerates having a size range of 10–20 micrometers is 8.7, and 2 g of a 25% aqueous solution of glutaraldehyde is added to crosslink the gelatin and the solution is cooled to 30° C.

To form the final conductive surface layer, 24 g of a 5% aqueous solution of EMA-1103 is added and 100 g of a 45% carbon black dispersion containing Regal 400 carbon black is added and diluted with 380 g of water.

This is slowly added to the agglomerate system. As the carbon black dispersion is added, it is deposited on the surface of the agglomerates. After 20–25 minutes of stirring there is essentially no background in the water phase and the pH of the system is 8.6. The pH is lowered to 6.0 with 10% acetic acid and diluted with an additional 500 g of water.

To obtain a dry powder the slurry is spray dried in a Bowen laboratory spray drier with a spray wheel, an inlet temperature of 280° F., and an outlet temperature of 160° F. The powder is collected, screened through a 200-mesh sieve and then tested in a 3M VQC II copier. Test results indicate that the print quality is comparable to the 3M VQC type 361 toner.

EXAMPLE X

A 2-liter stainless steel beaker is charged with 300 g of magnetic oxide manufactured by Pfizer Minerals, Pigment and Metals Division, New York, N.Y., and 250 g of water is added at 40° C. Using a variable speed Lightning stirrer, the magnetic oxide is dispersed for 10 minutes, and 100 g of a 10% aqueous solution of Superclear gelatin is slowly added and stirred for 25 minutes. The pH of this system is 6.8.

The agglomeration and terpolymer coating are carried out as in Example III. The final conductive layer is prepared with EMA-1103 and carbon black as in Example II. As the carbon black dispersion is added it is deposited on the surface of the agglomerates. After 20–25 minutes of stirring there is essentially no background in the water phase and the pH of the system is 8.6. The pH is lowered to 6.0 with 10% acetic acid and diluted with an additional 500 g of water.

To obtain a dry powder the slurry is spray dried in a Bowen laboratory spray drier with a spray wheel, an inlet temperature of 280° F., and an outlet temperature of 160° F. The powder is collected, screened through a 200-mesh sieve and then tested in a 3M VQC II copier. Test results indicate that the print quality is comparable to the 3M VQC type 361 toner.

EXAMPLE XI

A 2-liter stainless steel beaker is charged with 300 g of magnetic oxide manufactured by Reichard Coulston Inc., New York, N.Y., and 250 g of water at 40° C. is added. Using a variable speed Lightning stirrer, the magnetic oxide is dispersed for 10 minutes, and 100 g of a 10% aqueous solution of Superclear gelatin is added and stirred for 25 minutes. The pH of this system is 6.2.

The agglomerates are formed and overcoated, and the final conductive layer is formed as in Example I. A dry powder is then obtained by the spray drying procedure of Example I. Test results indicate that the print quality is comparable to the 3M VQC type 361 toner.

EXAMPLE XII

A carbon black slurry is prepared as in Example I, and 200 g of a 10% aqueous solution of Superclear gelatin is poured in and stirred for 15 minutes. The pH of this system is 5.8.

The agglomeration and terpolymer coating are carried out as in Example III. At this point the pH of the agglomerates, having a size range of 15–20 micrometers is 8.6, and 4 g of 25% aqueous glutaraldehyde is added.

The final surface conductive layer is formed with EMA-1103 and carbon black, as in Example I.

The dry powder is obtained as in Example X. Test results indicate that the print quality is comparable to the 3M VQC type 361 toner.

EXAMPLE XIII

The process of Example III is repeated, using 300 g of gelatin, and the pH of the carbon black and gelatin is 5.4.

The agglomeration and terpolymer coating is carried out as in Example IV. The pH of the agglomerates having a size range of 15–20 micrometers is 8.6, and 6 g of a 25% aqueous glutaraldehyde solution is added.

The final conductive layer is prepared as in Example II.

The drying is carried out as in Example XII. Test results indicate that the print quality is comparable to the 3M VQC type 361 toner.

EXAMPLE XIV

A 2-liter stainless steel beaker is charged with 300 g of magnetic oxide manufactured by Reichard Coulston Inc., New York, N.Y., and 250 g of water is added at 40° C. Using a variable speed Lightning stirrer the magnetic oxide is dispersed for 10 minutes, and 100 g of a 10% aqueous solution of Superclear gelatin is poured in and stirred for 25 minutes. The pH of this system is 6.2.

Agglomerates are then formed as in Example I, and the terpolymer of Example I is used for the coating. At this point the pH of the agglomerates having a size range of 5–20 micrometers is 8.6. Add 2 g of a 25% aqueous solution of glutaraldehyde to crosslink the gelatin and allow to cool to 30° C.

The final conductive coating is prepared as in Example I. The material is then spray dried to obtain a powder as in Example II. Test results indicate that the print quality is comparable to the 3M VQC type 361 toner.

EXAMPLE XV

Example XIV is repeated using 180 g of carbon black, instead of 55 g. Test results indicate that the print quality is comparable to the 3M VQC type 361 toner.

EXAMPLE XVI

Example III is repeated with the terpolymer coating on the agglomerates, which have a size range of 5–20 micrometers at a pH of 8.6. Two grams of 25% aqueous glutaraldehyde is added to crosslink the gelatin.

In this Example, no conductive surface layer is formed. The slurry is spray dried in a Bowen laboratory steel beaker and 100 g of a 45% carbon black dispersion containing Regal 400 carbon black manufactured by CDI Dispersions, Newark, New Jersey, diluted with 380 g of water is slowly added to the agglomerate system. As the carbon black dispersion is added, it is deposited on the surface of the agglomerates. After 20–25 minutes of stirring there is essentially no background in the water phase and the pH of the system is 8.6. The pH is lowered to 6.0 with 10% acetic acid and an additional 500 g of water is added.

To obtain a dry powder, the slurry is spray dried in a Bowen laboratory spray drier with a spray wheel, an inlet temperature of 260° F., and an outlet temperature of 140° F. to remove the water. The powder is collected, screened through a 200-mesh sieve and tested in a 3M VQC II copier. Test results indicate that the print quality is comparable to the 3M VQC type 361 toner.

EXAMPLE V

A magnetic oxide dispersion, agglomerates, and an overcoat are prepared as in Example III.

At this point the pH of the agglomerates having a size range of 5–20 micrometers is 8.6. Then 2 g of a 25% aqueous solution of glutaraldehyde is added to crosslink the gelatin and it is cooled to 30° C.

To form the final conductive surface layer, 24 g of a 5% aqueous solution of EMA-1103 ethylene maleic anhydride copolymer manufactured by Monsanto, St. Louis, Missouri, is added to the stainless steel beaker and 100 g of a 45% carbon black dispersion containing Regal 400 carbon black manufactured by CDI Dispersions, Newark, New Jersey, diluted with 380 g of water is slowly added to the agglomerate system. As the carbon black dispersion is added, it is deposited on the surface of the agglomerates. After 20–25 minutes of stirring there is essentially no background in the water phase and the pH of the system is 8.6. The pH is lowered to 6.0 with 10% acetic acid and an additional 500 g of water is added.

To obtain a dry powder, the slurry is spray dried in a Bowen laboratory spray drier with a spray wheel, an inlet temperature of 280° F., and an outlet temperature of 160° F. to remove the water. The powder is collected, screened through a 200-mesh sieve and then tested in a 3M VQC II copier. Test results indicate that the print quality is comparable to the 3M VQC type 361 toner.

EXAMPLE VI

A magnetic oxide dispersion, agglomerates, and an overcoat are prepared as in Example III.

At this point the pH of the agglomerates having a size range of 10–20 micrometers is 8.7. Then 2 g of a 25% aqueous solution of glutaraldehyde is added to crosslink the gelatin and it is cooled to 30° C.

To form the final conductive surface layer, 24 g of a 5% aqueous solution of EMA-1103 ethylene maleic anhydride copolymer manufactured by Monsanto, St. Louis, Missouri, is added to the stainless steel beaker and 100 g of a 45% carbon black dispersion containing Regal 400 carbon black manufactured by CDI Dispersions, Newark, New Jersey, diluted with 380 g of water is slowly added to the agglomerate system. As the carbon black dispersion is added, it is deposited on the surface of the agglomerates. After 20–25 minutes of stirring there is essentially no background in the water phase and the pH of the system is 8.6. The pH is lowered to 6.0 with 10% acetic acid and an additional 500 g of water is added.

To obtain a dry powder the slurry is spray dried in a Bowen laboratory spray drier with a spray wheel, an inlet temperature of 280° F., and an outlet temperature of 160° F. to remove the water. The powder is collected, screened through a 200-mesh sieve and then tested in a 3M VQC II copier. Test results indicate that the print quality is comparable to the 3M VQC type 361 toner.

EXAMPLE VII

A 2-liter stainless steel beaker is charged with 150 g of magnetic oxide dispersion containing 76.4% magnetic oxide manufactured by Wright Industries, Inc., Brooklyn, New York, and 250 g of water at 40° C. is added, using a variable speed Lightning stirrer to disperse the magnetic oxide for 10 minutes. One hundred grams of a 10% aqueous solution of Superclear gelatin manufactured by Swift & Company, Chicago, Illinois, is added and stirred for 15 minutes. The pH of this system is 7.1.

The agglomerates and terpolymer are then prepared as in Example IV.

To obtain a dry powder the slurry is spray dried in a Bowen laboratory spray drier with a spray wheel, an inlet temperature of 280° F., and an outlet temperature of 160° F. to remove the water. The powder is collected, screened through a 200-mesh sieve and then tested in a 3M VQC II copier. Test results indicate that the print quality is not comparable to the 3M VQC type 361 toner. There is considerable background and fuzziness of the image, due to the limited quantity of magnetic oxide.

EXAMPLE VIII

A magnetic oxide dispersion is agglomerated according to the procedure in Example III.

The overcoat for the core is a copolymer emulsion of styrene-butyl methacrylate having the monomer ratio — 80:20 prepared by interpolymerizing the two monomers in aqueous emulsion using the anionic surfactant A-103. One hundred grams of this emulsion having 40% solids is slowly added to the slurry in the stainless steel beaker. At this point, 15 g of a 5% aqueous solution of EMA-1103 ethylene-maleic anhydride copolymer is added to induce agglomeration. Microscopic observation indicates that agglomeration has occurred and that the agglomerates are 10–20 micrometers in diameter, and 2 g of a 25% aqueous solution of glutaraldehyde is added to crosslink the gelatin and allowed to cool to 30° C.

To form the final conductive surface layer 10 g of a 5% aqueous solution of EMA-1103 is added to the stainless steel beaker, and 100 g of a 45% carbon black dispersion containing Regal 400 carbon black is weighed out and diluted with 380 g of water. This is slowly added to the agglomerate system. As the carbon black dispersion is added it is deposited on the surface of the agglomerates. After 20–25 minutes of stirring, there is essentially no background in the water phase and the pH of the system is 8.6. The pH is lowered to 6.0 with 10% acetic acid and the solution is diluted with an additional 500 g of water.

To obtain a dry powder, the slurry is spray dried in a Bowen laboratory spray drier with a spray wheel, an inlet temperature of 280° F., and an outlet temperature of 160° F. The powder is collected, screened through a 200-mesh sieve, and then tested in a 3M VQC II copier.

spray drier with a spray wheel, an inlet temperature of 280° F., and an outlet temperature of 140° F. The powder is collected and screened through a 200-mesh sieve and then tested in a 3M VQC II copier. Test results showed that the copies have very high background and images are very poorly defined. When this toner sample is blended with 1% carbon black added and retested, the copies are comparable to the 3M 361 toner copies.

EXAMPLE XVII

The magnetic oxide dispersion in aqueous gelatin is carried out as in Example I. Then, 200 g of a 50% solids polyvinyl acetate emulsion containing anionic surfactant (Polyco 2140, manufactured by Borden Chemical, Leominster, Mass.) is charged to a beaker, and 200 g of 40° C. water is added. This is then slowly added to the stainless steel beaker. At this point, microscopic examination indicates that agglomeration has occurred and the agglomerates are 3–8 micrometers in diameter.

The terpolymer overcoat and the final conductive layer are added as in Example I. The slurry is spray dried as in Example I and the dried powder is screened through a 200-mesh sieve and tested in a 3M VQC II copier. Test results indicate that the print quality is comparable to the 3M VQC type 361 toner.

EXAMPLE XVIII

Example XVII is repeated using 320 g of A-25 polyethylene emulsion, instead of the Polyco 2140. Test results indicate that the print quality is not comparable to the 3M VQC type 361 toner. There is considerable background and fuzziness of the image.

EXAMPLE XIX

The procedure of Example III is followed to prepare the agglomerate, except that 100 g of a 45% carbon black dispersion containing Regal 400 carbon black is added to the A-25 before agglomeration. The agglomerates are 5–12 micrometers in diameter. The terpolymer coating is then added, and coated agglomerates having a size range of 8–20 micrometers at pH 8.6 are obtained.

After crosslinking with glutaraldehyde, the conductive layer is formed by adding 50 g of Uformite F-492 urea-formaldehyde, manufactured by Rohm and Haas, Philadelphia, Pa., to the slurry.

To obtain a dry powder the slurry is spray dried in a Bowen laboratory spray drier with a spray wheel, an inlet temperature of 400° F., and an outlet temperature of 160° F. The powder is collected, screened through a 200-mesh sieve and then tested in a 3M VQC II copier. Test results indicate that the print quality is comparable to the 3M VQC type 361 toner.

EXAMPLE XX

Example XIX is repeated, using 23 g of Cymel 370 melamine-formaldehyde, manufactured by American Cyanamid, dissolved in 50 g of isopropanol, in lieu of the urea-formaldehyde.

To obtain a dry powder the slurry is spray dried in a Bowen laboratory spray drier with a spray wheel, an inlet temperature of 370° F., and an outlet temperature of 160° F. The powder is collected, screened through a 200-mesh sieve and then tested in a 3M VQC II copier. Test results indicate that the print quality is comparable to the 3M VQC type 361 toner.

What is claimed is:

1. A process for preparing direct imaging, pressure fixable particulate magnetic toners which process is carried out in an aqueous medium and comprises dispersing a particulate magnetic material in the aqueous medium; adding a pressure-sensitive adhesive organic resin; adding a surfactant and agglomerating agent to agglomerate the magnetic material and pressure-sensitive adhesive and form a barrier layer over the agglomerate particles; adding a strengthening resin emulsion to the aqueous agglomerate-containing medium and encapsulating the agglomerate particles and barrier layer to provide a strengthening coat over the barrier layer; and adding an emulsion of a conductive material to provide an outer conductive layer on the strengthening coat.

2. A process according to claim 1 wherein the magnetic material is barium titanate, chromium dioxide, or an iron oxide.

3. A process according to claim 1 wherein the magnetic material is magnetite.

4. A process according to claim 1 wherein the pressure-sensitive adhesive is polyvinyl acetate, polyethylene emulsion, non-elastomeric low-melting acrylic resin, an elastomeric resin, or a mixture thereof.

5. A process according to claim 1 wherein the agglomerating agent has a melting temperature of at least 100° C.

6. A process according to claim 1 wherein the agglomerating agent is gelatin or a non-gelatin water-soluble polymer or a colloid.

7. A process according to claim 1 wherein the strengthening resin has a melting point in the range of 100° to 150° C.

8. A process according to claim 1 wherein the conductive material is a resin having a conductivity when dry of from $10^{-2}$ to $10^{-10}$ mho/centimeter or a mixture of a resin and conductive particles.

9. A process according to claim 8 wherein the conductive particles are carbon black.

10. A process according to claim 1 wherein the particles having a conductive layer are dried.

11. A process according to claim 10 wherein the particles are spray dried.

12. A process according to claim 10 wherein the temperature of the particles during drying does not exceed about 100° C.

* * * * *